United States Patent [19]

Achelpohl

[11] 4,308,021

[45] Dec. 29, 1981

[54] APPARATUS FOR DEPOSITING SECTIONS SEVERED FROM A WEB OF FILM

[75] Inventor: Fritz Achelpohl, Lengerich, Fed. Rep. of Germany

[73] Assignee: Windmöller & Hölscher, Lengerich, Fed. Rep. of Germany

[21] Appl. No.: 110,458

[22] Filed: Jan. 8, 1980

[30] Foreign Application Priority Data

Jan. 23, 1979 [DE] Fed. Rep. of Germany ..... 2902519

[51] Int. Cl.[3] ..... B31B 23/14

[52] U.S. Cl. ..... 493/196; 271/186; 271/196; 493/204; 493/342; 493/418

[58] Field of Search ..... 156/512, 510, 515, 497; 93/33 H, 33 R, DIG. 1, 93 HT; 493/194–196, 362, 204, 200, 201, 239, 203, 342, 418, 450; 271/196, 186, 195, 211, 177, 65, DIG. 9

[56] References Cited

U.S. PATENT DOCUMENTS

| | | | |
|---|---|---|---|
| 3,675,522 | 7/1972 | Hull | 271/196 X |
| 3,893,382 | 7/1975 | Bosse et al. | 493/194 |
| 4,027,580 | 6/1977 | Sundin | 271/186 X |
| 4,083,747 | 4/1978 | Rochla | 156/512 X |
| 4,128,049 | 12/1978 | Lehmacher | 156/512 X |

FOREIGN PATENT DOCUMENTS

| | | | |
|---|---|---|---|
| 2354963 | 5/1975 | Fed. Rep. of Germany | 93/33 H |
| 2825156 | 12/1979 | Fed. Rep. of Germany | 93/8 WA |
| 1061145 | 3/1967 | United Kingdom . | |
| 1296531 | 11/1972 | United Kingdom . | |
| 1536877 | 12/1978 | United Kingdom . | |

*Primary Examiner*—James F. Coan

*Attorney, Agent, or Firm*—Fleit & Jacobson

[57] ABSTRACT

Apparatus for depositing successive sections, such as carrier bag blanks, severed from the leading end of a web of superposed film layers fed through a transverse welding and severing station comprises nozzles for holding said leading end taut by means of an air jet, revolving suckers for engaging said leading end, and holding means to which said leading end is transferred by the suckers after each section has been severed.

14 Claims, 3 Drawing Figures

APPARATUS FOR DEPOSITING SECTIONS SEVERED FROM A WEB OF FILM

The invention relates to an apparatus for depositing sections severed from a web of film fed between a transverse welding and transverse severing device, comprising air jet nozzles on both sides of the film for stretching its freely advanced end and means holding the sections at their margins facing the nozzles.

To make bags closed by a base seam, it is known to pull a web of tubular film forward by means of feed rollers by one bag length at a time and, by means of blow nozzles disposed at both sides of the web of tubular film, to advance the leading floppy end of the web in a taut condition through means which apply the transverse weld seams and transverse severing cuts. Each time a bag has been welded and severed from the web of tubular film, the air jet lifts the leading end of the web of tubular film from the welding jaws in case it is still adhering to them. If the bag or section severed from the web of tubular film is individually placed in front of the welding and severing means or onto a stack, there is a danger that the strong jet of air lifts the deposited bag or upsets the stack.

In an apparatus of the aforementioned kind known from DE-OS No. 25 57 819 and described in prior Patent Application Pat. No. 28 33 236.7–27, the formation of a stack directly behind the transverse welding and transverse severing tool is made possible in that the severed bag is spiked onto a row of needles for holding the bag at the same time as the severing cut is executed. However, in the known apparatuses special measures have to be taken so that the stacks of bags which are pushed off the rows of needles and taken away are not loosened by the air jet and thrown into disorder.

In the known apparatus as well as that according to the prior patent application, the bag successively severed from the advanced web of tubular film can be deposited and stacked only if their trailing margin is held fixed at the instant the severing cut is executed because otherwise the air jet would carry the severed sections away in an uncontrolled manner. However, the simultaneous holding of the trailing edge of the severed section is particularly difficult if it is also to be provided with a transverse weld seam, as is for example necessary in the production of tank top bags.

It is therefore the problem of the present invention to provide an apparatus with which sections severed from a multi-layer web of film or from a tubular film and held taut by a jet of air while being passed through a transverse welding and transverse severing apparatus can be positively and reliably deposited for the purpose of stacking.

This problem is solved according to the invention in an apparatus of the aforementioned kind in that suckers are provided which engage the leading end of the web of film stretched by the air jet, are equipped with a drive and, after the section has been severed, transfer its suction-attracted zone to the holding means disposed beyond the air jet which stretches the web of film. In the apparatus according to the invention, the suckers are capable of reliably gripping the leading end of the web of film which is stretched by the air jet, before the section containing this leading end is severed from the tubular web of film or the multi-layer web of film. After severing the section, the drive for the suckers is switched on so that they can reliably transfer the suction-attracted margin of the section to the holding means which are disposed beyond the air jet so that the latter can no longer act directly on the severed sections. Since the suckers engage the leading end of the section before it is severed from the web of film stretched by the air jet, the edges of the section can be provided with transverse weld seams or transverse severing cuts without taking precautions that, simultaneously with the processing or directly after release by the processing tool, the trailing edge of the section has to be fixed to avoid disruption by the air jet.

To facilitate reliable gripping of the leading end of the web of film flapping in the air jet, it is desirable to provide at least three suckers arranged in a row, of which two engage the web at the margins and one at its central region.

In a further embodiment of the invention, the suckers consist of the ends of suction tubes which are secured on a shaft and pivotable between the position where they suction-attract the web of film and the position where they transfer the sections to the holding means.

Desirably, the shaft is intermittently pivotable through 180° between the suction-attracting and transferring position of the suckers in the sequence of severing or welding the sections, so that the sections severed from the web of film are transferred in a position turned through 180° to the holding means disposed in a plane below the air jet.

Desirably, the shaft is provided with rows of suckers displaced by 180° so that the suckers can be turned through 180° in the sequence of severing the sections from the web of film and in the same sense.

Desirably, a grate supporting the web of film stretched by the air jet is provided downstream of the transverse welding and transverse severing device. This grate limits fluttering of the end of the web in the air jet so that the suckers can reliably suction-attract the leading edge of the web of film.

In a further embodiment of the invention, at least one air jet nozzle is provided above the holding means which are adjoined by a support for the section or sections, the nozzle being directed towards the severed end and smoothing the section down onto the support. Since the section is turned through 180° by the pivotal movement of the suckers, it is only such equipment that will ensure that the section lies flat on its support in a stretched condition. Instead of air jet nozzles, other means may be provided for smoothing down the sections.

Desirably, rods or guides over which the suckers pull the sections during depositing are provided between the zones of the suckers where they suction-attract and transfer the sections, the rods or guides being semi-circular along the pivotal path of the suckers. Such guide means ensure that the sections can be flung in an almost stretched form onto their support or, in the case of stacking, onto the previously deposited sections, while they are being turned through 180°.

Other advantageous embodiments of the invention have been described in subsidiary claims 9 to 13.

One example of the invention will now be described in more detail with reference to the drawing, wherein.

Figure 1:
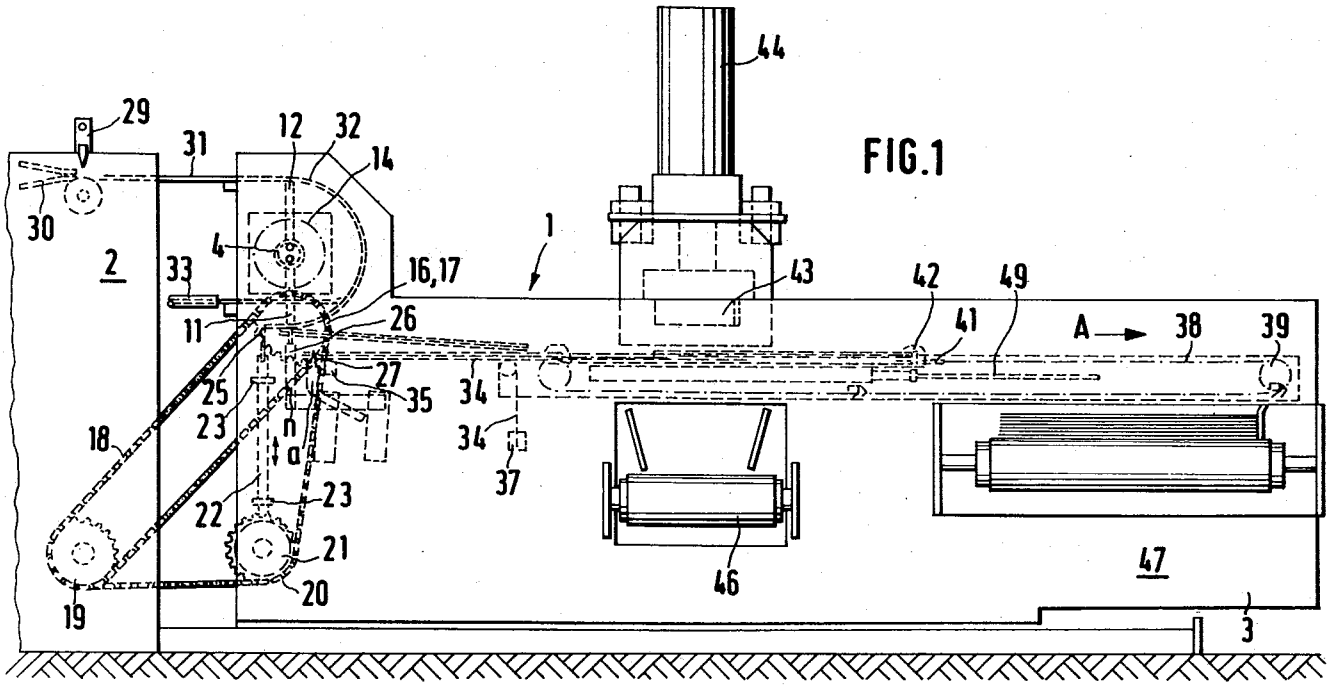
FIG. 1 is a diagrammatic side elevation of an apparatus for making stacks of tank-top bags.

In the apparatus shown in FIG. 1, sections are severed in the transverse welding and severing device 2 from the web S of tubular film provided with side folds. The sections closed at both ends by transverse weld seams are stacked in the stacking station to form stacks containing a predetermined number. The finished stacks are pulled out of the stacking station and fed to the stamping device 43, 44 in which they are provided with tank-top cut-outs. The finished stacks of tank-top bags are then successively deposited on an intermittently driven conveyor belt 47.

The stacking station 1 downstream of the transverse severing and welding station 2 comprises a suction air cylinder 4 which is rotatably mounted in its side walls 3 and which consists of a shaft 5 provided with two throughgoing parallel bores 6, 7. Near the ends of the shaft 5, fixed connecting rings 9 provided with an annular groove 8 are placed on the shaft and connected to a vacuum pump by a hose 10. One of the annular grooves 8 is in constant communication with the bore 6 and the other with the bore 7. Suckers 11 and 12 are placed on the bores 6 and 7, the suckers 11 of the bore 6 being offset from the suckers 12 of the bore 7 by 180°. The shaft 5 is rotatably mounted in ball bearings 13 in the side walls 3 of the frame. For driving purposes, it is connected to the output shaft of step-operated gearing 14 of which the driving gear is in mesh with the gear 16 which is fixed to the sprocket 17.

Figure 2:
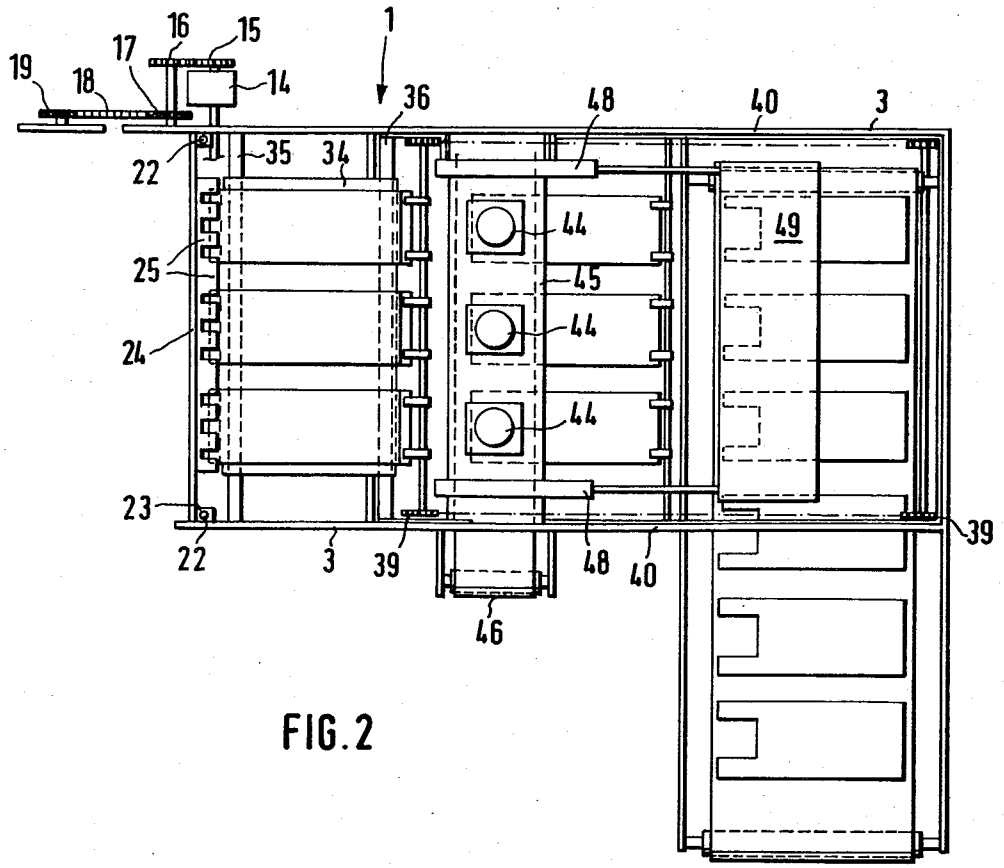
FIG. 2 is a plan view of the FIG. 1 apparatus.
Figure 3:
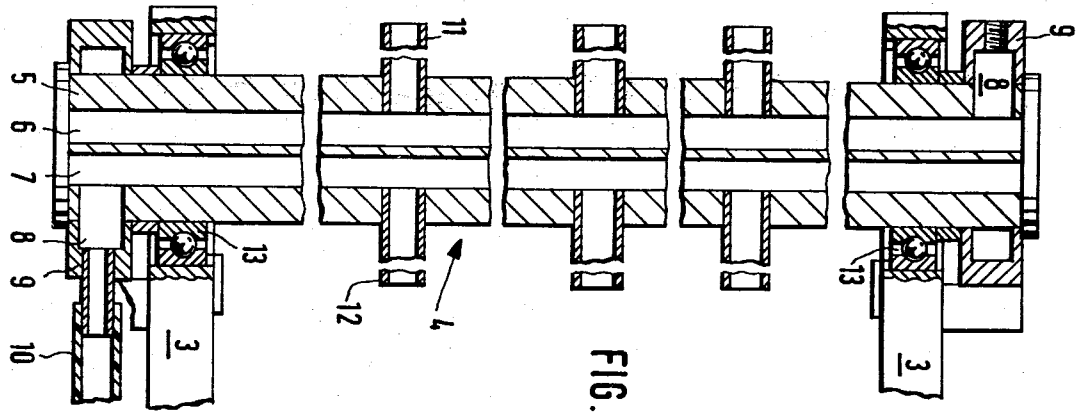
FIG. 3 is an enlarged section of the suction means for receiving and depositing the sections severed from the web of film.

In FIG. 2, the connection of the output shaft of the step-operated gearing 14 to the shaft 5 of the suction air cylinder 4 is indicated by a chain-dotted line. Further, to facilitate drawing, the gear 16 as well as the sprocket 17 are shown offset from each other. The sprocket 17 is driven by a chain 18 which runs over the main drive 19 of the machine and also drives the sprocket 20 of an eccentric 21.

The eccentric 21 controls two lifting rods 22 which are vertically displaceable in plummer blocks 23. A cross-member 24 carrying stripping fingers 25 is secured to the other end of these lifting rods 22.

These stripping fingers pull the individual tube sections from the suckers 11, 12 by which they are alternately supplied and push them onto groups of needles 26, 27 to form the stack, the needle groups being alternately in a spiking position in the sequence of stack formation. The suckers 11, 12 can suction-attract the tube sections so far behind their leading edge that they may be pushed onto the rows of needles 26, 27 without hindrance by the stripping fingers 25. However, it is also possible for the stripping fingers 25 to pass in a comb-like manner through the suckers 11, 12 which consist of suction tubes also arranged in rows.

The purpose of the needle grips 26, 27 which consist of rows of needles, pass through in a comb-like manner and reach the spiking position in alternate cycles, is to permit a stack to be changed in the sequence of supplying the individual stacks after a stack of sections has been spiked. For this purpose, the rows of needles 26, 27 passing through each other in a comb-like manner are secured to driven carriers which alternately move one row of needles from their spiking position to a position displaced towards the conveyor belt and, before or during commencement of the advancing movement, retract the row which is in its advanced position and move it to the spiking position during the advancing cycle. During the advancing motion of each row of needles, a drive is started which takes the stacks away. The alternately operating groups of needles 26, 27 passing through each other in a comb-like manner are described in the applicants prior Patent Application Pat. No. 28 33 236.7–27 to which reference may be made.

The stroke of the rods 22 carrying the stripping fingers 25 is designed to be such that the stripping fingers 25 are, in their lowered position, at the level of the last uppermost section spiked on the respective row of needles 26, 27. As the stack height increases, the sections are therefore pushed down more deeply onto the needles of the respective row. By means of this construction, the rod 22 can be rigid, so that it need not be telescopically extensible against the force of a spring to push each bag down to the root of the needles. The stroke of the rods can thereby also be reduced. The rods 22 are pressed by springs (not shown) against the eccentrics 21 that lift same.

The leading end of the tubular web S provided with side folds is fed to the suckers 11, 12 which are in the receiving position by means of an air jet produced by the air jet nozzles 30 arranged at both sides of the tubular web S. To guide the leading end of the tubular web that is advanced in a taut condition by the air jet, a grate is provided which consists of rake-like rods 31 and which prevents excessive flapping of the end of the tubular web in the air jet. The individual tube sections are severed from the tubular web S by the hot knife 29 only when their leading end has been engaged by the suckers 11 or 12. The hot knife not only severs the tube sections from the web of tubular film but also provides them with transverse weld seams at their leading ends.

The sections gripped by the suction grippers 11 or 12 at their leading ends are, after severing from the web of tubular film, swung to a plane below the feeding plane of the tubular web S by turning the suckers through 180° whereby the sections are also inverted through 180°. In the lower plane, the edges of the sections gripped by the suckers are spiked onto the rows of needles 26 or 27 by the stripping fingers 25. To guide the tube sections into the stacking plane beneath the feeding plane of the tubular web S, a cage 32 is provided which consists of semi-circular rods or guides through which the suckers 12 pass so that the sections are pulled over the outside of the cage. By means of this guiding cage 32, the sections are flung onto the growing stack with practically no formation of folds. In addition, an air jet nozzle 33 is provided above the growing stack of sections so that the air jet sweeps over the stack substantially parallel thereto and smooths each last section to be supplied onto the stack. Since the guide cage 32 is of grate formation, the air jet can readily pass therethrough.

Stacking itself takes place on a support consisting of a belt 34. The belt 34 is secured by one end to a cross-member 35 which is fixed to the machine frame behind the groups of needles and parallel thereto. The other end of the belt hangs over a rod 36 secured in the machine frame at a spacing from the cross-member 35 and parallel thereto and it is held taut by being pulled downwardly by weights 37 secured to its end. Behind the support formed by the belt 34 a gripper chain engages which feeds the finished stacks in steps to the stamping station and the storage station. By reason of the fact that the support for the stacks in the stacking station is formed by a belt 34 which is held taut, the spacing between the needle groups and gripper chain 38 can readily be varied when the size is changed.

The gripper chains 38 as well as the sprockets 39 of the gripper chain 38 are mounted in a frame 40 which is displaceable in the side walls 3 of the machine frame. The rod 36 which determines the length of the support formed by the taut belt 34 is secured in the displaceable frame 40 so that a change in size can be effected by elongating the support simply by displacing the frame 40.

After a finished stack has been taken away by the gripper chains, the last stack to be formed is pushed off the row of needles in the spiking position and its leading end is inserted in the opened grippers 42 of the gripper chain, which then close. The next stack is then formed in a position which overlaps the last stack in scale formation, until the last stack is pulled out from beneath the forming stack by switching on the gripper chain drive.

Each stack that has been pulled off is pulled by the gripper chains 38 in a proper disposition beneath the stamping device 43, 44 in which it is supported by a table 41 which is secured in the frame 40. The gripper chains 38 pull each stack of sections onto the table 41 in a manner such that the trailing end of each stack is disposed under the punch 43 of the stamping cylinder 44.

As will be evident from FIG. 2, three stamping cylinders 44 are mounted on a cross-member 45 which, in turn, is secured in the side walls 3 of the machine frame. The illustrated machine operates in three parallel paths, i.e. in a triple process. The waste pieces stamped out by the punches 43 of the stamps 44 reach a discharge conveyor belt 46 beneath the table.

After the stamping step, the gripper chain 38 moves during the next conveying cycle of the gripper chain 38 in the direction of the arrow A together with the stack of tank-top bags formed by the stamping operation until the stack is disposed above the conveyor belt 47. During this movement, a supporting plate 49 consisting of a slide is likewise extended in the direction of the arrow A by the cylinder 48 so that the stack of tank-top bags pulled down from the table 41 continues to be supported. Just before the gripper 41 which is in its limiting position above the conveyor belt 47 is opened, the supporting plate 48 is retracted, whereafter the gripper is opened so that the stack of tank-top bags is deposited on the conveyor belt 47 which takes it away. In the sequence of depositing the finished stack of tank-top bags on the conveyor belt 47, a further stack of sections is pulled by the next gripper 42 under the punch 43, 44 whilst the next following stack is being spiked on a row of needles.

For better clarity, the table 41 and rows of needles have been omitted from FIG. 2.

When placing the machine in operation, in order that the first stack of bags remains pulled smooth during motion of one row of needles from the position 'spiking n' to the position 'depositing a', a single bag is inserted in the chain grippers 42 so that, during movement of the chain in the direction of the arrow A and simultaneous displacement of the needle grippers, no relative motion will take place between the stack to be placed in the next gripper and the belt 34.

During further operation, the stack already located on the belt 34 will ensure displacement of the superposed stack without the formation of folds because while a row of needles is moved from the spiking position n to the depositing position a, the stack still lying on the belt 34 is pulled from under the forming stack by the gripper chain 38.

I claim:

1. Apparatus for depositing sections severed from a web (S) of film fed between a transverse welding and transverse severing device, comprising air jet nozzles on both sides of the film for stretching a freely advanced end of the film, means for holding margins of the film facing the nozzles, suckers (11, 12) for suction attracting and for engaging the freely advanced end of the web (S) of film stretched by the air jet nozzles, means for rotating the suckers after the section has been severed from the web to transfer the engaged section to holding means, and holding means (25, 26, 27) disposed beyond the air jet nozzles which stretch the web (S) of film for receiving the severed section from the suckers.

2. Apparatus according to claim 1, characterised in that the suckers consist of ends of spaced apart suction tubes (11, 12), and wherein the apparatus includes a shaft (5) for supporting the suction tubes, the suction tubes being pivotable between the position where they suction-attract the web of film and the position where they transfer the sections to the holding means (26, 27).

3. Apparatus according to claim 2, characterised in that said means for rotating comprises means for intermittently rotating the shaft (5) through 180° between the suction-attracting and transferring positions of the suckers (11, 12) in the sequence of severing or welding the sections.

4. Apparatus according to claim 2 or claim 3, characterised in that the rows of suckers (11, 12) are offset by 180° on the shaft (5).

5. Apparatus according to claim 4, characterised in that the suckers (11, 12) are mounted on the shaft (5) in rows.

6. Apparatus according to one of claims 1, 2, or 3, characterised in that a grate means (31) for supporting the web (S) of film stretched by the air jet nozzles is provided downstream of the transverse welding and transverse severing device (2).

7. Apparatus according to one of claims 1, 2, or 3, characterised in that the apparatus further comprises at least one air jet nozzle (33) provided above the holding means (25, 26, 27), and a support (34) for the severed section or sections adjoining the at least one air jet nozzle, said at least one air jet nozzle being directed towards a severed end of the section and smoothing the section down onto the support or the stack forming thereon.

8. Apparatus according to one of claims 1, 2, or 3, characterised in that the apparatus comprises rods or guides (32) forming a grate over which the suckers (11, 12) pull the sections during transfer of the sections, the rods or guides being semi-circular along a pivotal path of the suckers.

9. Apparatus according to claim 1, characterised in that a stack-forming station (1) is provided for depositing the sections.

10. Apparatus according to claim 1, characterised in that the holding means comprise a row of needles (26, 27) and an intermittently moved rake or stripper (25) which individually pushes the suction-attracted ends of the sections onto the row of needles (26, 27).

11. Apparatus according to claim 10, characterised in that said holding means comprises two rows of needles (26, 27) passing between each other in a comb-like manner, the sections being alternately spiked thereon to form a stack and the apparatus further comprising conveying means (38, 42) for pushing finished stacks from the rows of needles for further transport.

12. Apparatus according to claim 11, characterised in that the conveying means for further transport comprises a pair of conveyor chains (38), grippers (42) carried by the conveyor chains for engaging the leading end of the pushed off stack, the apparatus further comprising a stamping station (43, 44) downstream of the holding means, and a discharge conveyor (47) downstream of the stamping station, said conveying means intermittently conveying the stack to the stamping station and the discharge conveyor.

13. Apparatus according to claim 7, characterised in that the grate means comprises a weighted belt, a cross-member 36 for supporting the weighted belt, the cross-member being movable to elongate the support provided by the grate means.

14. Apparatus for depositing sections severed from a web (S) of film fed through a transverse welding and transverse severing device, the device including means for severing individual sections from the web (S), said apparatus comprising:

air jet nozzles disposed on both sides of the web upstream of the means for severing for stretching a freely advanced end of the web (S);

suckers (11, 12) disposed downstream of the means for severing for suction attracting and engaging the freely advanced end of the web (S) stretched by the air jet nozzles;

means operative after severing of a section for rotating the suckers through an arc of substantially 180° from a position engaging the freely advanced end of the web (S) to a position transferring the severed section;

means for defining a support for the severed section during rotation of the suckers (11, 12);

holding means (25, 26, 27) disposed at the transfer position of the suckers for receving a severed section from the suckers;

means adjoining the holding means for forming a support for a severed section received by the holding means; and at least one air jet nozzle (23) disposed above said holding means and directed towards the severed end of the section for smoothing the section onto the support or a stack forming thereon.

* * * * *